United States Patent [19]

Engle et al.

[11] Patent Number: 4,604,074

[45] Date of Patent: Aug. 5, 1986

[54] PUSH TOY

[75] Inventors: T. Scott Engle, Manhattan Beach; Jeffrey B. Poznick, La Crescenta, both of Calif.

[73] Assignee: Mattell, Inc., Hawthorne, Calif.

[21] Appl. No.: 771,544

[22] Filed: Aug. 30, 1985

[51] Int. Cl.[4] ..... A63H 29/08

[52] U.S. Cl. ..... 446/171; 446/448

[58] Field of Search ..... 446/144, 171, 170, 172, 446/168, 237, 418, 419, 451, 452, 450, 491, 448, 449

[56] References Cited

U.S. PATENT DOCUMENTS

| | | | |
|---|---|---|---|
| D. 167,975 | 11/1951 | Fisher et al. . | |
| 480,619 | 8/1892 | Park . | |
| 906,471 | 12/1908 | Townsend . | |
| 1,543,143 | 6/1925 | Woznuck . | |
| 1,557,321 | 10/1925 | Parke . | |
| 1,736,176 | 11/1929 | Shepherd . | |
| 1,890,944 | 12/1932 | Holmes | 446/449 |
| 2,352,676 | 7/1944 | Gainsley . | |
| 2,377,104 | 5/1945 | Rapaport . | |
| 2,521,331 | 9/1950 | Biggs . | |
| 3,523,385 | 8/1970 | Noble . | |
| 4,295,294 | 10/1981 | Rosenwinkel et al. | 446/144 |

*Primary Examiner*—Mickey Yu

*Attorney, Agent, or Firm*—Ronald Goldman; Melvin A. Klein; John Mesaros

[57] ABSTRACT

A push toy having a wheel housing rotatably supporting a pair of wheels with an impeller within the housing actuated upon rotation of the wheels, the impeller coacting with the interior of a generally transparent, continuous loop tube formed partially within the handle with a plurality of colored spheres therein, rotation of the impeller moving the string of spheres up the tube to the apex thereof, whereupon the spheres drop under the force of gravity. The toy may be operated in forward or reverse directions.

15 Claims, 5 Drawing Figures

PUSH TOY

BACKGROUND OF THE INVENTION

The background of the invention will be discussed in two parts:

1. Field of the Invention

This invention relates to push toys, and more particularly to a wheeled push toy having colored spheres actuated through a conduit on movement thereof.

2. Description of the Prior Art

For toddlers, wheeled push toys with a handle resembling lawn mowers have provided a source of amusement for decades, particularly the types of push toys which have some form of motion or animation connected therewith.

One such early toy is shown and described in U.S. Pat. No. 480,619, issued to Park on Aug. 9, 1892, such patent being entitled "Toy" and disclosing a wheeled push toy having a wheel with an annular channel formed in a side thereof for captively retaining a plurality of ball members which rotate within the channel upon movement of the toy.

U.S. Pat. No. 906,471 is directed to another such toy, and is entitled "Wheeled Toy", such patent being issued to Townsend on Dec. 8, 1908, the toy including a pair of wheels on an axle with projecting crank pins on the axle actuating spring members upon movement of the toy, thus propelling captively retained balls along a wire extending through the balls.

Another such toy is shown and described in U.S. Pat. No. 1,543,143, entitled "Toy", issued to Woznuck, on June 23, 1925, the toy being a wheeled push toy having one wheel thereof toothed to coact with the extending post ends of a rotary cage mounted for rotation in response to movement of the toy on a surface.

Another such wheeled push toy is shown and described in U.S. Pat. No. 1,577,321, issued Oct. 13, 1925, to Parke, for a "Toy", such toy being a wheeled push toy having reciprocatory ball members manipulated on movement of the toy.

U.S. Pat. No. 1,736,176, entitled "Toy", issued to Shepherd on Nov. 19, 1929, such patent disclosing a wheeled toy having a runway for marbles or other rolling elements with a first terminal end of the runway being at a higher elevation than the other terminal end, which coacts with an element responsive to movement of the wheels for carrying a marble from the lower to the higher elevation for thereafter rolling under the force of gravity to the lower end.

Another wheeled push toy resembling a lawnmower is shown and described in U.S. Pat. No. 2,352,676, issued to Gainsley on July 4, 1944, such patent being entitled "Toy", and having a pair of wheels on an open framework rotary cage with balls therein moving around in response to pushing of the toy.

Another such wheeled push toy is shown in U.S. Pat. No. 2,377,104, issued May 29, 1945, to Rapaport for a "Toy", the patent disclosing a lawnmower like toy with a rotary cage including angularly disposed rods having washer-shaped members thereon slidable on the rods during movement of the toy.

U.S. Pat. No. 2,521,331, was issued to Biggs, on Sept. 5, 1950, and is entitled "Marble Cage Push Toy", the patent disclosing a cage formed of two wheels with angularly disposed transparent tubes therebetween with marbles therein movable under the force of gravity during movement of the toy. The tubular path may be a separate unit or may be formed with part of the path within the wheel members.

Another push toy is shown and described in U.S. Pat. No. 3,523,385, entitled "Beehive Push Toy", issued Aug. 11, 1970 to Noble, the toy having inner and outer spaced beeehive members with a helical surface configuration and a generally central vertical tubular member. Balls are elevated through the tubular member by a wheel actuated plunger providing an upward force, whereupon the balls descend between the surfaces from the top by the helical configuration.

Another such push toy is shown in U.S. Pat. No. D. 167,975, issued to Fisher et al on Oct. 21, 1952, for a "Trundle Toy", the toy being in a form resembling a lawnmower with graphic depictions on the rotary surface thereof.

It is an object of the present invention to provide a new and improved push toy.

It is another object of the present invention to provide a new and improved push toy having the handle thereof configured for passage therethrough of rolling objects such as spheres.

It is a further object of the present invention to provide a new and improved push toy having a transparent tubular handle with colored spheres therein with a wheel actuated impeller elevating the string of spheres during movement of the toy along a surface.

SUMMARY OF THE INVENTION

The foregoing and other objects are accomplished by providing a push toy having a wheel housing rotatably supporting a pair of wheels with an impeller within the housing actuated upon rotation of the wheels, the impeller coacting with the interior of a generally transparent, continuous loop tube formed partially within the handle with a plurality of colored spheres therein, rotation of the impeller moving the string of spheres up the tube to the apex thereof, whereupon the spheres drop under the force of gravity. The toy may be operated in forward or reverse directions.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
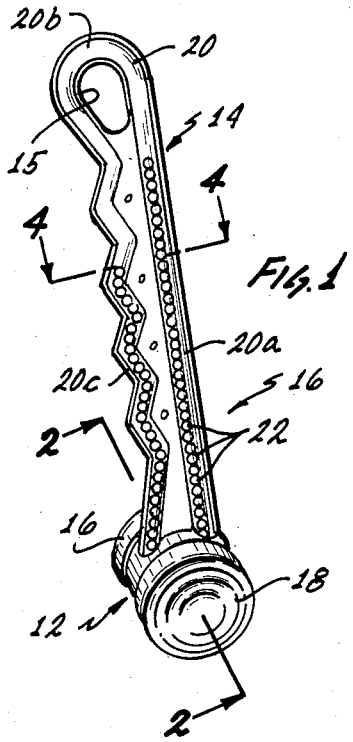
FIG. 1 is a perspective view of the push toy in accordance with the present invention.

Referring now to the drawings, and particularly to FIG. 1, there is shown a push toy generally designated 10, having a wheel housing, generally designated 12, secured to a handle member, generally designated 14, with an opening 15 therethrough for gripping by the hand of a toddler. The wheel housing 12 rotatably supports a pair of wheels 16 and 18. The handle 14 has formed therein a portion of a continuous loop tube 20, the portion being of generally transparent, inverted generally U-shape, which has movably enclosed therein a string of a plurality of spheres 22, which may be varicolored marbles or the like. The handle portion of tube 20 has a first generally straight arm section 20*a*, an arcuate apex section 20*b* and a "zig-zag" arm section 20*c* formed in the handle 14.

As the child pushes the toy 10 along a surface, the wheels 16 and 18 rotate, and, depending on whether the toy 10 is being pushed or pulled, the spheres 22 will move up one arm 20*a* or 20*c* of the tubular portion 20 to the apex 20*b* thereof, whereupon the spheres 22 will descend down the other arm 20*c* or 20*a* under the force of gravity. To operate, there are a sufficient number of spheres 22 to equal or exceed, in length, the length of the longer of the two arms 20*a* or 20*c* (including that portion of the conduit within the wheel housing 12) to enable the spheres to pass over the apex 20*b*.

Referring now to FIGS. 2 through 5, the wheel housing 12 and handle 14 are formed as a unit of two matingly attachable parts, preferably formed as by molding of clear plastic material, with the conduit means or tube 20 formed integrally therewith in the form of a continuous loop. The two parts, after assembly of the axle 32 and impeller 30, and after insertion of the string of spheres 22, are then suitably secured to each other, such as by screws 33.

The wheel housing 12 is formed as a two part generally drum shaped housing with a generally centrally disposed impeller housing 24, having an impeller 30 rotatably supported therein. The center of the impeller housing 24 has aligned apertures 26 and 28 for passage therethrough of an axle member 32, with the wheels 16 and 18 fixedly secured to the outer ends thereof. Also secured for rotation with the axle 32 within the impeller housing 24 is the impeller 30 which, as can be seen in FIG. 3, has a centrally disposed keyed aperture 34 for matingly engaging a keyed section of the axle 32.

The impeller housing 24 defines a cavity or reservoir of sufficient width for rotation of the impeller 30 therein with the periphery of the impeller housing 24 having a generally U-shaped tubular portion 20*d* of cross-sectional diameter slightly greater than the diameter of the spheres 22, the portion 20*d* being a continuation of the tube 20. The impeller 30 is formed of a width less than the diameter of the tubular portion 20*d*, with the inner diameter of the tubular portion 20*d* being slotted for access by the impeller 30.

Figure 3:
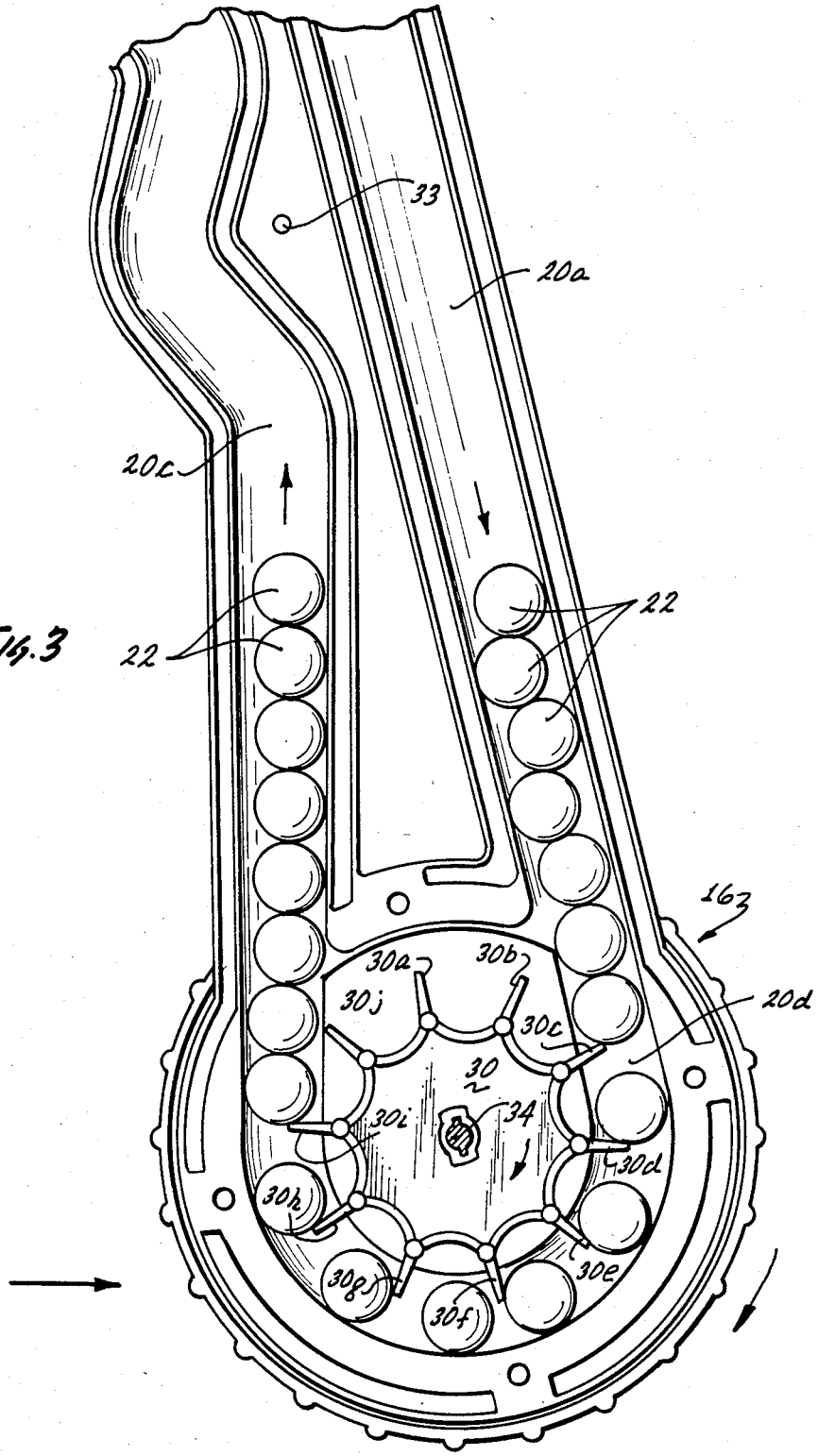
FIG. 3 is a cross-sectional view of the lower portion of the push toy depicted in FIG. 2, as viewed generally along line 3—3 thereof.
Figure 5:
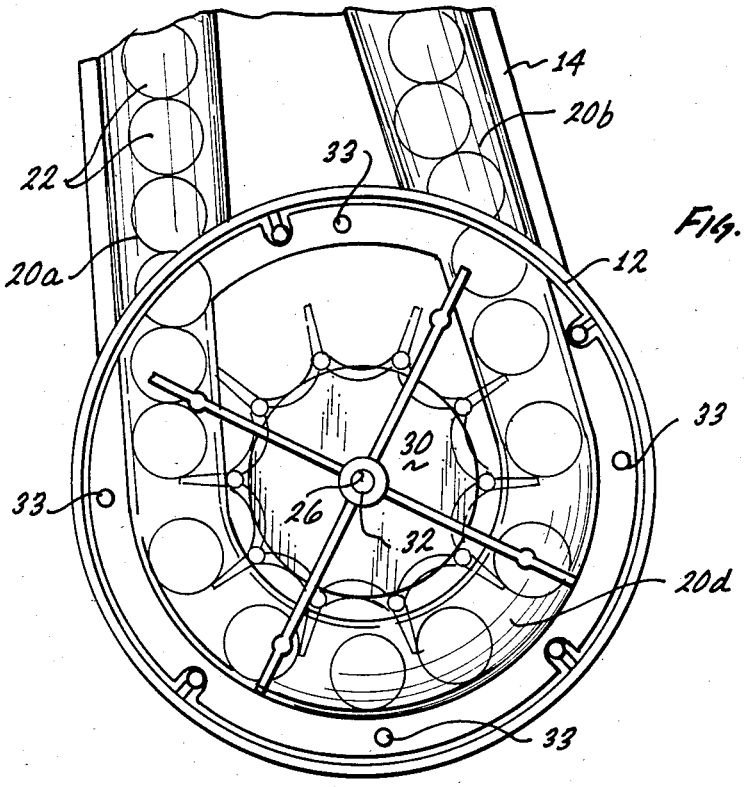
FIG. 5 is an end view of the lower portion of the push toy of FIG. 1 with one of the wheel members removed to illustrate details.

By reference to FIGS. 3 and 5, in side elevational view, the impeller 30 is formed in the shape of a gear with ten equiangularly spaced radially extending teeth or paddles 30*a*, 30*b*, etc., with the intervening web portions between paddles being arcuately configured to form recesses capable of receiving therein only one sphere 22. The spacing between the outer edge of each of the paddles 30*a*, etc. and the outer diametric surface of the tubular portion 20*d* is selected to enable separation of the string of spheres 22 during travel thereof within the tube 20 and enable upward motion of the string of spheres 22 as the toy 10 is pushed or pulled. For this purpose, the paddles 30*a*–30*j* intrude into the tubular portion 20*d* approximately half way.

Figure 2:
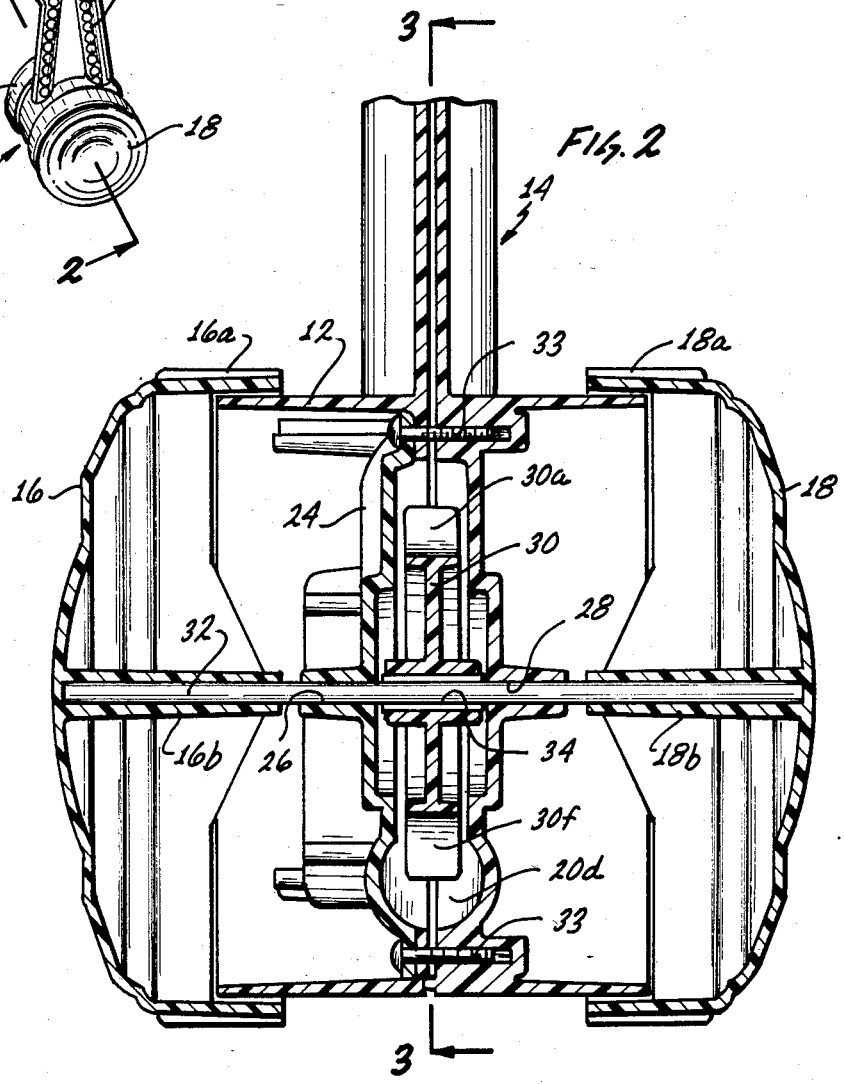
FIG. 2 is a cross-sectional view of the lower portion of the push toy of FIG. 1 as viewed generally along line 2—2 thereof.
Figure 4:
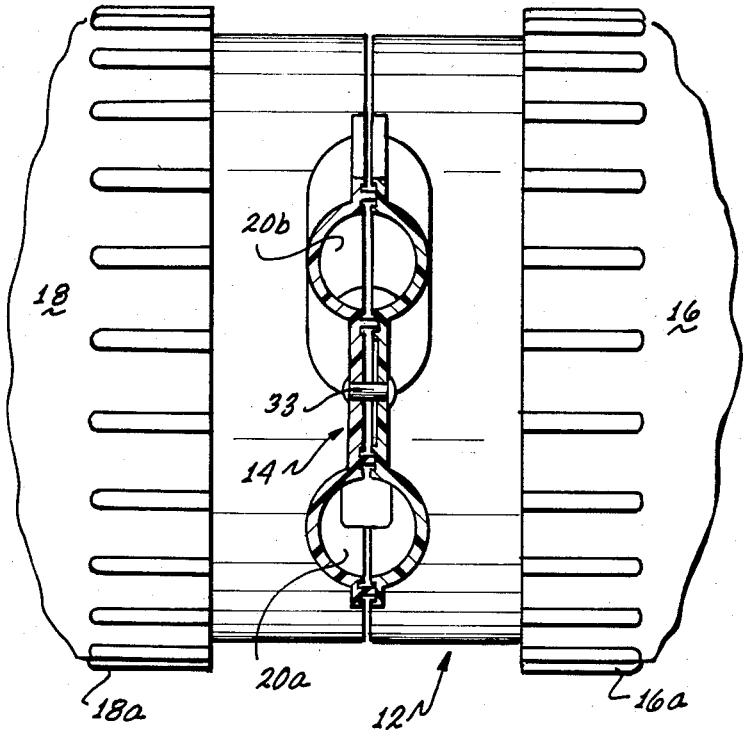
FIG. 4 is a cross-sectional view of the push toy of FIG. 1 as viewed generally along line 4—4 thereof.

For the purpose of precluding the entry of fingers into the interior of the working mechanism, and to provide a compact configuration, as shown in FIGS. 2, 3 and 4, the wheels 16 and 18 are generally cup-shaped and somewhat hollow and formed with a peripheral tread portion 16*a* and 18*a*, the inner diameter of which overlies the outwardly extending drum surface of the wheel housing 12, in proximate relation thereto. The outer surface of each of the tread portions 16*a* and 18*a* are provided with ribs to facilitate friction with a surface upon which the toy 10 is pushed. The center of the interior of each of the wheels 16 and 18 has an integrally formed hub portion 16*b* and 18*b* with an axle receiving recess formed therein for frictional engagement with the axle 32. The axle 32 is preferably formed of metal, such as steel or a suitable alloy.

As the toy 10 is pushed along a surface, the outer ribs of the wheel treads 16*a* and 18*a* cause rotation of the axle 32 coupled thereto, thus concurrently driving the impeller 30. By reference to FIG. 3, as the impeller 30 rotates in the direction of the arrow thereon, paddle 30*c* acts to block the string of spheres 22 within the tubular arm portion 20*a* which are urging downwardly under the force of gravity. Simultaneously, the string of spheres 22 in the tubular arm portion 20*c* is being urged upwardly as another sphere 22 enters this string, with paddle 30*i* providing the upwardly propelling force. As can be seen, the intervening paddles 30*d*–30*h*, in conjunction with the tubular portion 20*d*, form separate compartments, each of which contains one sphere 22. The length of the paddles 30*a*–30*j* in relation to the diameter of the spheres 22 must be such that a paddle passes under a sphere 22 which is resting on an adjacent sphere 22. The configuration of the web portions of the impeller 30 between paddles enables the toy 10 to operate effectively in the forward or reverse direction. Upon rotation of the impeller 30 in a given direction, the string of spheres 22 in one of the tubular portions, such as portion 20*c* increases in length until the uppermost sphere 22 approaches the apex 20*b* of the conduit or tube 20. The incremental addition of spheres 22 within the same arm portion thereafter causes the incremental release of spheres 22 over this apex 20*b* whereupon each sphere then descends down the tubular arm portion 20*a* under the force of gravity, therby providing both visual and audible entertainment for the child.

In construction, the toy 10 is uncomplicated, requiring only six parts exclusive of the marbles or spheres 22 and screws 33, is readily assembled, and is compact. Although the conduit or tube 20 has been described as being integrally formed with the handle 14, and the wheel housing 12 is formed in conjunction with the handle 14, it is to be understood that such elements may be separately formed and thereafter assembled. Howver, such a construction will not have the manufacturing simplicity of that shown and described. While there has been shown and described a preferred embodiment, it is to be understood that various other adaptations and modifications may be made within the spirit and scope of the invention.

We claim:

1. In a push toy, the combination comprising:

housing means;

at least one wheel rotatably coupled to said housing means and adapted for engaging a surface;

handle means coupled to said housing means for enabling an operator to move said at least one wheel on a surface with said handle means in a generally upright position;

at least partially transparent continuous conduit means on said handle means;

impeller means coupled for rotation upon rotation of said at least one wheel, said impeller means communicating with a portion of said conduit means;

a number of spherical elements movably positioned within said conduit means, the number of such elements and the configuration of said conduit means enabling, upon rotation of said impeller means, the movement of said spherical elements within said conduit means.

2. The push toy according to claim 1 wherein said conduit means are a continuous loop tube.

3. The push toy according to claim 2 wherein said toy includes two wheels interconnected by an axle and said impeller means is coupled to said axle.

4. The push toy according to claim 3 wherein said housing means includes an impeller housing with a portion of said conduit means within said impeller housing.

5. The push toy according to claim 1 wherein said conduit means are at least partially formed in said handle means and said conduit means has an inverted generally U-shaped tubular portion on said handle means with a first arm, a second arm and an interconnecting apex portion.

6. The push toy according to claim 5 wherein said impeller means is positioned adjacent said at least one drive wheel and is configured for urging said spherical elements up one of said first and second arms.

7. The push toy according to claim 6 wherein the number of said spherical elements, when placed end to end being, in length, greater than the length of each of said arms for enabling each of said spherical elements, in turn, upon reaching said apex portion, to descend down the other of said arms under the force of gravity.

8. In a push toy, the combination comprising:

a wheel housing having at least one wheel rotatably coupled thereto and adapted for engaging a surface;

handle means coupled to said wheel housing for enabling an operator to move said at least one wheel on a surface with said handle means in a generally upright position;

at least partially transparent conduit means at least partially on said handle means, said conduit means on said handle means being of an inverted generally U-shaped configuration with a first arm, a second arm and an apex at the junction of said arms;

a number of spherical elements movably positioned within said conduit means, the number of such elements, when placed end to end being, in length, greater than the length of each of said arms;

impeller means within said wheel housing and coupled for rotation upon rotation of said at least one wheel, said impeller means communicating with said spherical elements within said conduit means for urging said elements in an ascending direction up one of said first and second arms of said conduit means, the upper ones of said spherical elements then passing over the apex and descending down the other of said first and second arms of said conduit means.

9. The push toy according to claim 8 wherein said conduit means are at least partially formed within said handle means.

10. The push toy according to claim 9 wherein said conduit means includes a portion thereof within said wheel housing.

11. The push toy according to claim 10 wherein said impeller means is a generally gear-shaped member with equiangularly disposed paddle portions at least partially intruding into said portion of said conduit means within said wheel housing.

12. The push toy according to claim 8 wherein said wheel housing, said handle means and said conduit means are formed of two matingly attachable molded parts.

13. The push toy according to claim 12 wherein said two matingly attachable parts are formed to provide an impeller housing within said wheel housing with said impeller housing having a portion of said conduit means formed therein.

14. The push toy according to claim 13 wherein said impeller housing has aligned apertures for passage therethrough of an axle member, the portion of said axle member within said impeller housing being keyed for engaging a mating aperture in said impeller means.

15. The push toy according to claim 14 wherein said impeller means is a generally gear-shaped member with equiangularly disposed paddle portions at least partially intruding into said portion of said conduit means within said impeller housing.

* * * * *